US010499459B2

(12) United States Patent
Gomez

(10) Patent No.: US 10,499,459 B2
(45) Date of Patent: Dec. 3, 2019

(54) COOKTOP APPLIANCE AND TEMPERATURE SWITCH

(71) Applicant: Haier US Appliance Solutions, Inc., Wilmington, DE (US)

(72) Inventor: Eugenio Gomez, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 509 days.

(21) Appl. No.: 15/336,897

(22) Filed: Oct. 28, 2016

(65) Prior Publication Data

US 2018/0124869 A1 May 3, 2018

(51) Int. Cl.
*H05B 1/02* (2006.01)

(52) U.S. Cl.
CPC ..... *H05B 1/0266* (2013.01); *H05B 1/0219* (2013.01)

(58) Field of Classification Search
CPC ..... H05B 1/0266; H05B 1/0219; F24C 7/083
USPC ..... 99/281, 331; 219/446.1, 447.1, 448.19, 219/453.13, 462.1
See application file for complete search history.

(56) References Cited

U.S. PATENT DOCUMENTS 3,328,561 A 6/1967 Sakamoto et al.
5,945,017 A 8/1999 Cheng et al.
6,104,008 A * 8/2000 Larson ..... D06F 58/263 219/461.1
8,723,085 B2 * 5/2014 Callahan ..... F24C 7/087 219/446.1
9,220,130 B1 12/2015 Smith

FOREIGN PATENT DOCUMENTS

JP 2009043696 A 2/2009

* cited by examiner

*Primary Examiner* — Thien S Tran
(74) *Attorney, Agent, or Firm* — Dority & Manning, P.A.

(57) ABSTRACT

A cooktop appliance is generally provided herein. The cooktop appliance may include a cooktop panel, an electric heating element, a ferromagnetic tab, and a magnetic temperature switch. The electric heating element may be positioned at the cooktop panel. The electric heating element may include a first terminal and a second terminal. The ferromagnetic tab may be in thermal engagement with the electric heating element. The magnetic temperature switch may be positioned in selective magnetic engagement with the ferromagnetic tab. The magnetic temperature switch may be electrically connected in series with the second terminal and operable to restrict a voltage to the electric heating element above a predetermined temperature.

17 Claims, 6 Drawing Sheets

COOKTOP APPLIANCE AND TEMPERATURE SWITCH

FIELD OF THE INVENTION

The present subject matter relates generally to cooktop appliances, and more particularly to electric cooktop appliances.

BACKGROUND OF THE INVENTION

Cooking appliances, e.g., cooktops or ranges (also known as hobs or stoves), generally include one or more heated portions for heating or cooking food items within a cooking utensil placed on the heated portion. The heated portions utilize one or more heating sources to output heat, which is transferred to the cooking utensil and thereby to any food item or items within the cooking utensil. Typically, a controller or other control mechanism, such as an electromechanical switch, regulates the heat output of the heating source selected by a user of the cooking appliance, e.g., by turning a knob or interacting with a touch-sensitive control panel. The control mechanism may cycle the heating source between an activated or on state and a substantially deactivated or off state such that the average heat output of the heating source corresponds to the user-selected heat output level.

The control mechanism can utilize a temperature sensor to help control the heat output in order to regulate or otherwise limit the cooking utensil from reaching an undesired temperature level. The transfer of heat to the cooking utensil and/or food items may cause the food items or cooking utensil to overheat or otherwise cause unwanted and/or unsafe conditions on the cooktop. Although conventional cooking appliances may include a safety feature for estimating temperature at the cooking utensil, such systems are often unable to provide a suitable evaluation of the current conditions near the burner or at a cooking utensil disposed thereon. Moreover, conventional appliances may be unable to quickly evaluate the current or "live" conditions near the burner. In some systems, undesirable swings in temperature may occur at the heating source and/or cooking utensil before conventional appliances are able to detect that an excessive or deficient temperature has been reached. Additionally, some systems may rely on continued contact between the control mechanism and a heated element. Moreover, nuisance tripping may turn off a burner before it would be otherwise desired.

Accordingly, a cooktop appliance having a system for detecting temperature conditions near a heat source would be desirable. More particularly, it may be desirable for a cooktop appliance to have a system that addresses one or more of the conditions discussed above.

BRIEF DESCRIPTION OF THE INVENTION

Aspects and advantages of the invention will be set forth in part in the following description, or may be obvious from the description, or may be learned through practice of the invention.

In one aspect of the present disclosure, a cooktop appliance is provided. The cooktop appliance may include a cooktop panel, an electric heating element, a ferromagnetic tab, and a magnetic temperature switch. The electric heating element may be positioned at the cooktop panel. The electric heating element may include a first terminal and a second terminal. The ferromagnetic tab may be in thermal engagement with the electric heating element. The magnetic temperature switch may be positioned in selective magnetic engagement with the ferromagnetic tab. The magnetic temperature switch may be electrically connected in series with the second terminal and operable to restrict a voltage to the electric heating element above a predetermined temperature.

In another aspect of the present disclosure, a cooktop appliance is provided. The cooktop appliance may include a cooktop panel, an electric heating element, an element frame, a ferromagnetic tab, and a magnetic temperature switch. The electric heating element may be positioned at the cooktop panel. The element frame may support the electric heating element. The element frame may be positioned below the electric heating element. The ferromagnetic tab may extend from the element frame. The magnetic temperature switch may be positioned in selective magnetic engagement with the ferromagnetic tab. The magnetic temperature switch may be operable to restrict a voltage to the electric heating element above a predetermined temperature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
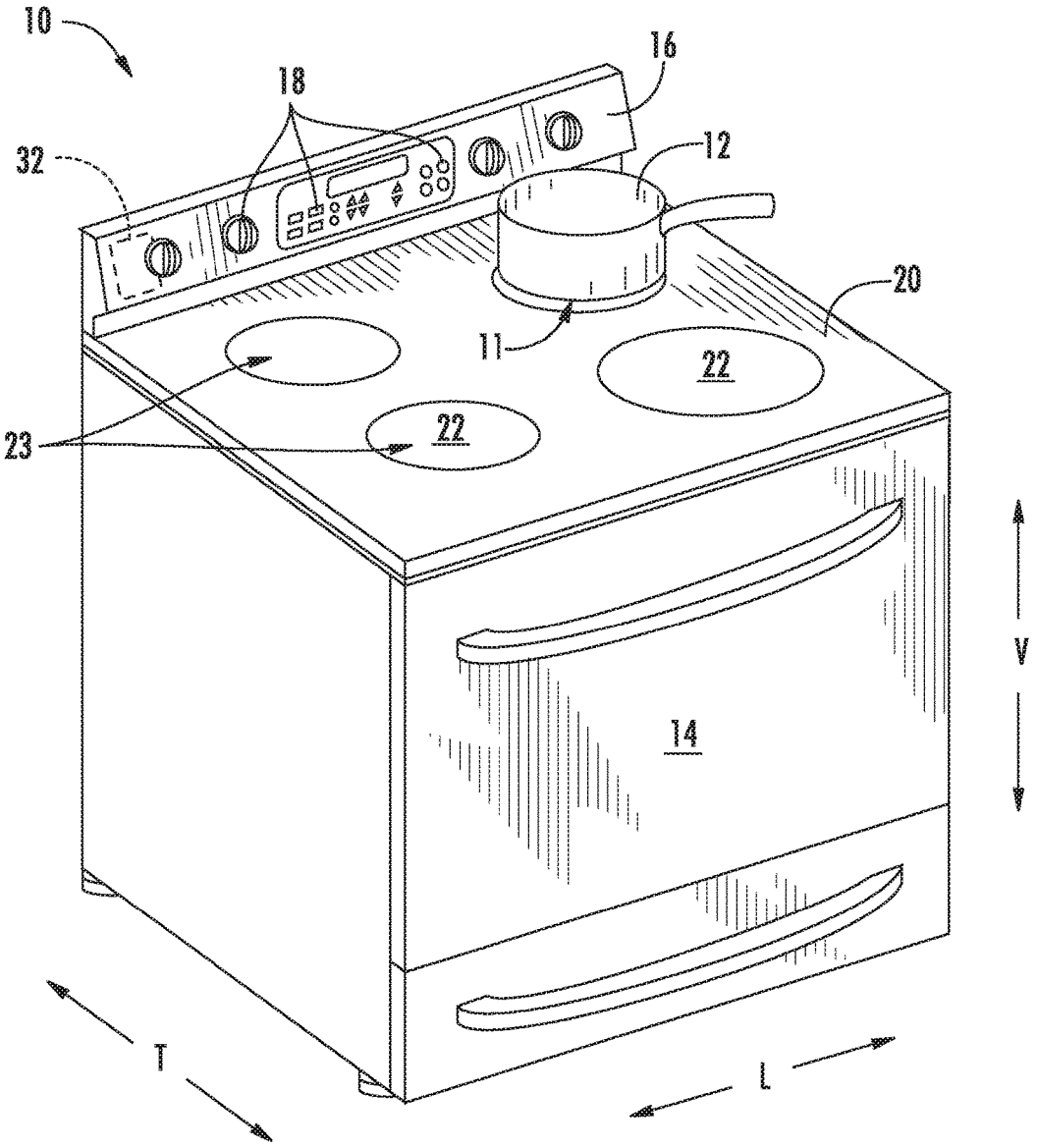
FIG. 1 provides a perspective view of a cooktop appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure provides a cooktop appliance that includes at least one heating assembly. The heating assembly may have one or more electric heating elements and a ferromagnetic tab that can receive heat transferred from the electric heating element(s). A temperature switch may be provided, including a portion that can be magnetically attracted to the ferromagnetic tab. When the ferromagnetic tab exceeds a certain temperature, the temperature switch may lose magnetic attraction and restrict or cut off a voltage to one or more of the electric heating elements. If and/or when the temperature falls by a sufficient amount, the temperature switch may regain magnetic attraction and again permit or direct the voltage to the electric heating element(s).

Turning now to the figures, FIG. 1 provides a perspective view of an example cooktop appliance 10. Generally, cooktop appliance 10 defines a vertical direction V, a lateral direction L, and a transverse direction T. Each of the vertical direction V, lateral direction L, and transverse direction T may be mutually orthogonal to each other. As illustrated in FIG. 1, cooktop appliance 10 may be a range appliance that includes a generally horizontal cooking surface, such as a cooktop panel 20, disposed on and/or vertically above an oven cabinet. However, cooktop appliance 10 is provided by way of example only and is not intended to limit the present subject matter to any particular appliance or cooktop arrangement. Thus, the present subject matter may be used with other cooktop appliance configurations, e.g., cooktop appliances without an oven. Further, the present subject matter may be used in any other suitable appliance.

Cooktop panel 20 of cooktop appliance 10 includes one or more heating assemblies 22 having at least one heat zone 23. Cooktop panel 20 may be constructed of any suitable material, e.g., a ceramic, enameled steel, or stainless steel. As shown in FIG. 1, a cooking utensil 12, such as a pot, kettle, pan, skillet, or the like, may be placed or positioned on a heating assembly 22 to cook or heat food items placed within the cooking utensil 12. In some embodiments, cooktop appliance 10 includes a door 14 that permits access to a cooking chamber (not shown) of the oven cabinet of appliance 10, the cooking chamber for cooking or baking of food or other items placed therein.

Exemplary embodiments include a user interface 16 having one or more control inputs 18 permits a user to make selections for cooking of food items using heating assemblies 22 and/or the cooking chamber. As an example, a user may manipulate one or more control inputs 18 to select, e.g., a power or heat output setting for each heating assembly 22. The selected heat output setting of heating assembly 22 affects the heat transferred to cooking utensil 12 positioned on heating assembly 22. Although shown on a backsplash or back panel of cooktop appliance 10, user interface 16 may be positioned in any suitable location, e.g., along a front edge of the appliance 10. Control inputs 18 may include one or more buttons, knobs, or touch screens, as well as combinations thereof.

Some embodiments further include a controller 32 operably connected, e.g., electrically coupled, to user interface 16 and/or control inputs 18. Generally, operation of cooking appliance 10, including heating assemblies 22, may be controlled by controller 32. In some embodiments, controller 32 is a processing device and may include a microprocessor or other device that is in operable communication with components of appliance 10, such as heating assembly 22. Controller 32 may include a memory and microprocessor, such as a general or special purpose microprocessor operable to execute programming instructions or microcontrol code associated with a selected heating level, operation, or cooking cycle. The memory may represent random access memory such as DRAM, and/or read only memory such as ROM or FLASH. In one embodiment, the processor executes programming instructions stored in memory. The memory may be a separate component from the processor or may be included onboard within the processor. Alternatively, controller 32 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Control inputs 18 and other components of cooking appliance 10 may be in communication with (e.g., electrically coupled to) controller 32 via one or more signal lines or shared communication busses. Heating assembly 22 may be operably connected to controller, e.g., at one or more respective terminal pairs.

Operation of heating assembly 22 may be regulated such that the temperature or heat output of heating assembly 22 corresponds to a temperate or heat output selected by a user of cooktop appliance 10 For example, one or more electric heating elements 21 (FIGS. 2 through 5) may be cycled between an activated state and a deactivated state, i.e., between on and off, such that the average temperature or heat output over each cycle corresponds to or approximates the selected temperature or heat output. That is, a duty cycle of heating element 21 may be controlled such that, based on the user's selection, heating element 21 is activated or turned on for a fraction or portion of the duty cycle and deactivates or turns off heating element 21 for the remainder of the duty cycle. A user of cooktop appliance 10 may, e.g., manipulate a control 18 associated with a heating assembly 22 to select a desired heat output or temperature for heating element 21 of the associated heating assembly 22. The selection by the user indicates what fraction or portion of the duty cycle heating element 21 should be activated or on, e.g., if the user selects the midpoint heat output or temperature, the duty cycle of heating element 21 may be controlled such that heating element 21 is on for half of the duty cycle and off for half of the duty cycle.

As illustrated in FIGS. 2 through 5, some heating assembly 22 embodiments include an electric heating element 21 defining a heat zone 23 (FIG. 1). Each electric heating element 21 may be supported on one or more support elements 30, which also help support cooking utensil 12 (FIG. 1) when the cooking utensil 12 is placed on cooktop panel 20. Further, although illustrated as forming a spiral shape by winding in coils around a center point, resistive coil(s) 24 may have a different number of turns, other shapes, or other configurations as well. Heating assemblies 22 may have any suitable shape, size, and number of defined heating zones 23. Optionally, each heating assembly 22 of cooking appliance 10 (FIG. 1) may be heated by the same type of heating source, or cooking appliance 10 may include a combination of different types of heating sources. Cooking appliance 10 may include a combination of heating assemblies 22 of different shapes and sizes. Moreover, one or more heating assemblies 22 may be positioned above or below cooktop panel 20.

Figure 2:
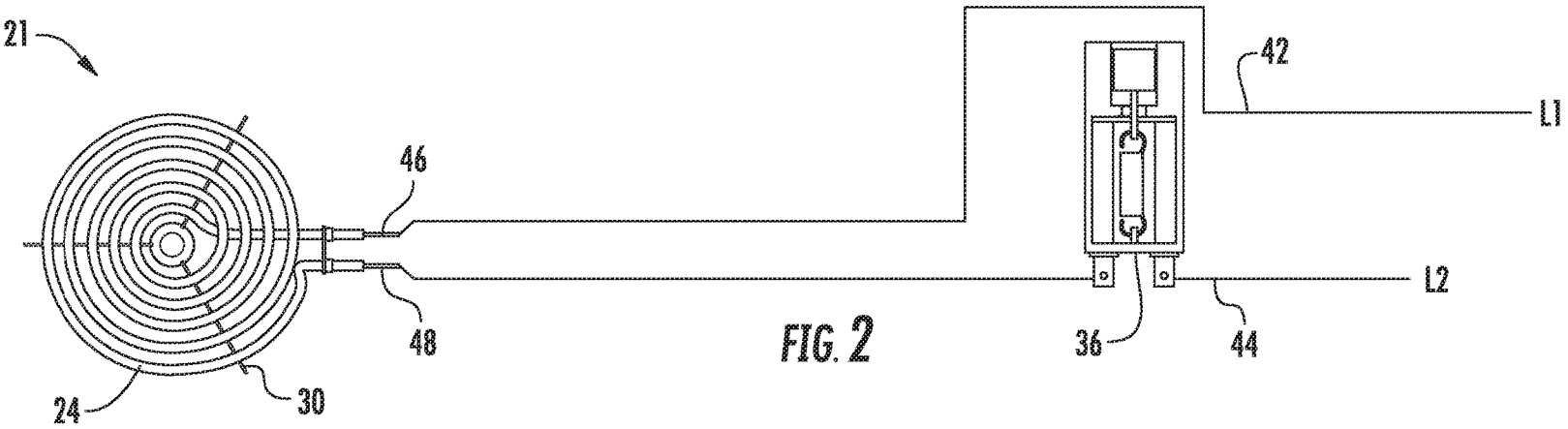
FIG. 2 provides a schematic view of a certain components for a cooktop appliance according to exemplary embodiments of the present disclosure, wherein a temperature switch is provided in an activated state.
Figure 3:
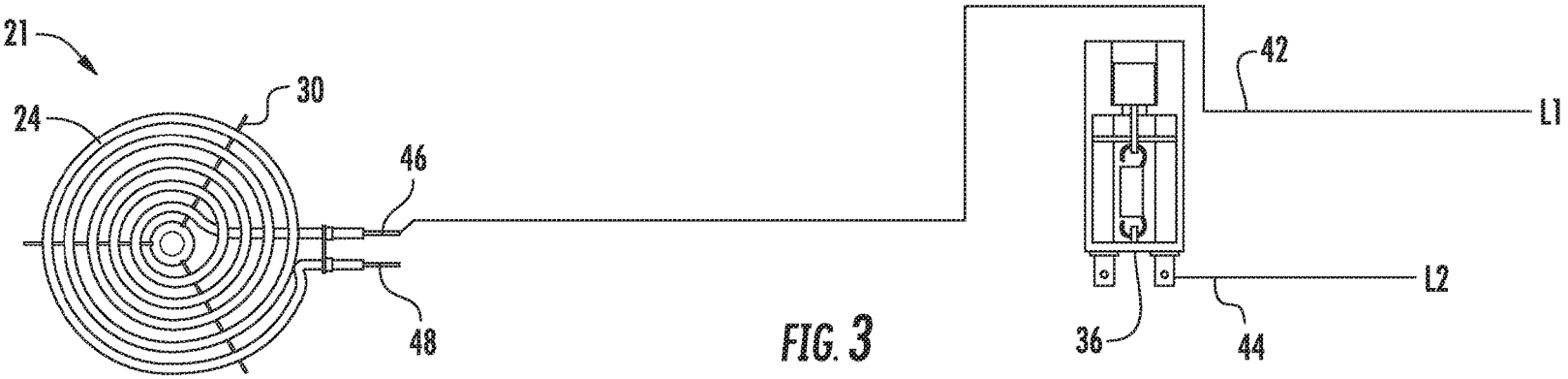
FIG. 3 provides a schematic view of certain components for the example cooktop appliance of FIG. 2, wherein the temperature switch is provided in a deactivated state.

In some embodiments, such as the example embodiment of FIGS. 2 and 3, electric heating element 21 is a single spiral shaped resistive coil for providing heat to a cooking utensil 12 (FIG. 1) positioned thereon. In some such embodiments, heating assembly 22 (FIG. 1) utilizes exposed, electrically-heated, planar coils that are helically-wound about a center point. Coils generally act as a heat source, i.e., as electric heating element 21, for heating cooking utensils 12 placed directly on heating assembly 22.

A first terminal 46 and a second terminal 48 may be provided for heating element 21. Specifically, first terminal 46 and second terminal 48 may be electrically coupled to heating element 21. An electrical current may be transmitted to a first resistive coil 24 at the terminals 46, 48. When a voltage differential is applied across first and second terminals 46, 48 of first resistive coil 24, a temperature of electric heating element 21 increases. First resistive coil 24 may be a CALROD® coil in certain exemplary embodiments.

A temperature switch 36 is generally provided as a safety mechanism separate from the controller 32. In some embodiments, temperature switch 36 is positioned proximate to electric heating element 21, as will be described in detail below. Generally, temperature switch 36 may be positioned such that a temperature adjacent to temperature switch 36 corresponds to a temperature of heating assembly 22 or cooking utensil 12 (FIG. 1) above heating assembly 22. Thus, temperature switch 36 may be configured for detecting the temperature of heating assembly 22 or cooking utensil 12 above electric heating element 21.

Temperature switch 36 may generally be operable to restrict a voltage to electric heating element 21 above a predetermined temperature. Specifically, temperature switch 36 may actuate from a first, e.g., activated, state (FIG. 2) to a second, e.g., deactivated, state (FIG. 3), based on a temperature at electric heating element 21. For instance, certain embodiments of temperature switch 36 are provided as a magnetic switch. As described in detail below, magnetic temperature switch 36 actuates or adjusts from the first state to the second state when a temperature at electric heating element 21 exceeds a predetermined threshold temperature. The threshold temperature may be any suitable temperature. For example, the threshold temperature may be about three hundred fifty degrees Celsius. As another example, the threshold temperature may be above three hundred sixty degrees Celsius. Optionally, the threshold temperature may be above four hundred degrees Celsius. As yet another example, the threshold temperature may between about ninety degrees Celsius and about four hundred twenty-five degrees Celsius. As used herein, the term "about" corresponds to within twenty-five degrees of a stated temperature when used in the context of temperature. The threshold temperature may be may be selected such that the threshold temperature accounts for a position of magnetic temperature switch 36 relative to heating assembly 22 and/or cooking utensil 12 (FIG. 1) above electric heating element 21.

A first electrical conduit 42 is coupled to first terminal 46 of electric heating element 21. First electrical conduit 42 is configured for operating at a first voltage, L1, with respect to ground. Thus, first electrical conduit 42 may be coupled or connected to a first voltage source operating at the first voltage L1 with respect to ground. Cooktop appliance 10 also includes a second electrical conduit 44 configured for operating at a second voltage, L2, with respect to ground. Thus, second electrical conduit 44 may be coupled or connected to a second voltage source operating at the second voltage L2 with respect to ground. The first and second electrical conduits 42, 44 may be any suitable electrical conduits, such as wires, cables, etc.

The first voltage L1 and the second voltage L2 have opposite polarities. In addition, a magnitude of the first voltage L1 with respect to ground may be about equal to a magnitude the second voltage L2 with respect to ground. As used herein, the term "about" corresponds to within ten volts of a stated voltage when used in the context of voltage. As an example, the magnitude of the first and second voltages L1, L2 may be about one hundred twenty volts with respect to ground. Thus, e.g., first electrical conduit 42 may be coupled to one phase of a two hundred forty volt household electrical supply, and second electrical conduit 44 may be coupled to the second phase of the two hundred forty volt household electrical supply.

Temperature switch 36 may be connected to second conduit 44 in series between second terminal 48 and second voltage L2, e.g., an electrical supply for L2. As described above, temperature switch 36 may selectively adjust between a first and second state. Accordingly, temperature switch 36 may selectively couple or connect second terminal 48 to second electrical conduit 44. By selectively coupling or connecting the second terminal 48 of electric heating element 21 to second electrical conduit 44, a power output of electric heating element 21 may be regulated with temperature switch 36.

Figure 4:
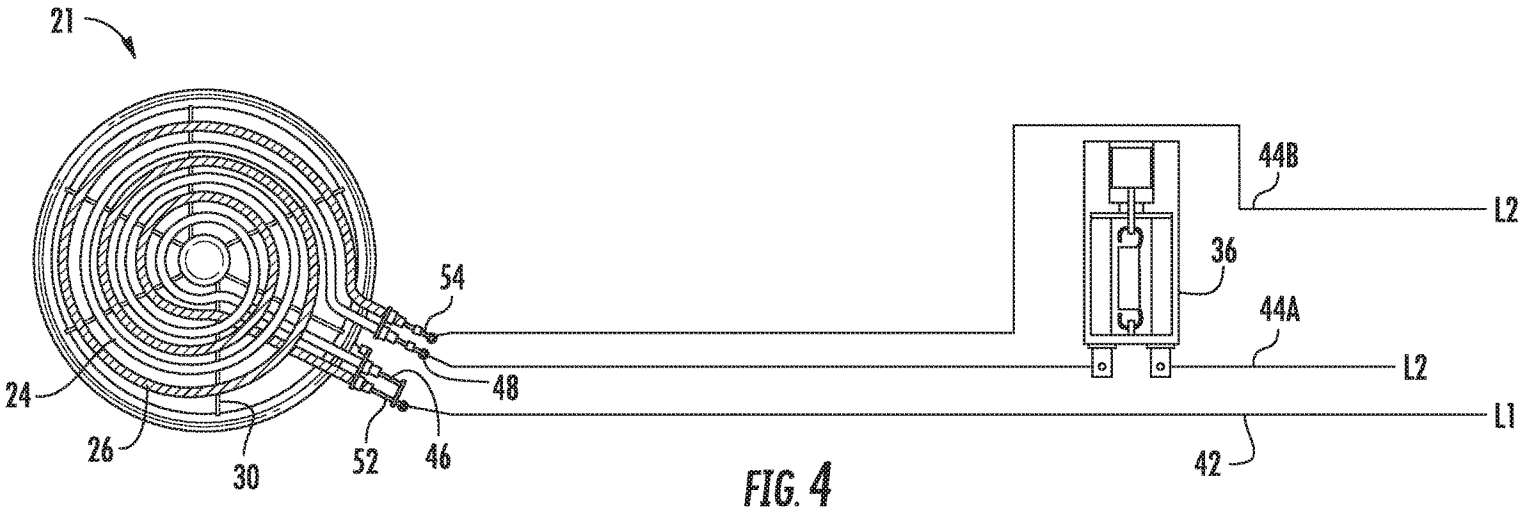
FIG. 4 provides a schematic view of a certain components for a cooktop appliance according to other exemplary embodiments of the present disclosure, wherein a temperature switch is provided in an activated state.
Figure 5:
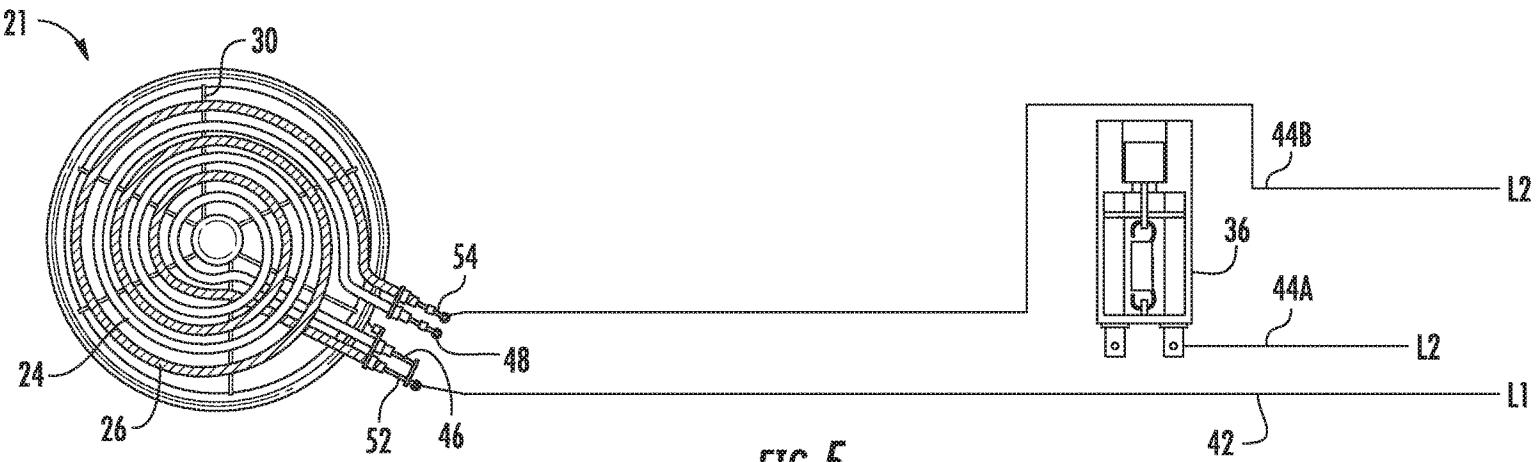
FIG. 5 provides a schematic view of certain components for the example cooktop appliance of FIG. 4 wherein the temperature switch is provided in a deactivated state.

As illustrated in FIGS. 4 and 5, optional heating assembly 22 embodiments include multiple resistive coils, e.g., a first resistive coil 24 and a second resistive coil 26, defining a heat zone 23 (FIG. 1) and electric heating element 21. Both resistive coils, 26 may be formed about the same center point. For instance, segments of first resistive coil 24 may alternate with the segments of second resistive coil 26 such that first and second electric coils 24, 26 are intertwined about the center point.

A first terminal 46 and a second terminal 48 may be provided for first resistive coil 24. A third terminal 52 and a fourth terminal 54 may be provided for second resistive coil 26. An electrical current may be transmitted to each resistive coil 24, 26 at the terminals 46, 48, 52, 54. When a voltage differential is applied across first and second terminals 46, 48 of electrical first coil 24, a temperature of electric heating element 21 increases. Additionally or alternatively, when a voltage differential is applied across third and fourth terminals 52, 54, a temperature of electric heating element 21 increases. First resistive coil 24 and/or second resistive coil 26 may be a CALROD® coil in certain exemplary embodiments.

As noted above, temperature switch 36 may be positioned such that a temperature of temperature switch 36 corresponds to a temperature of heating assembly 22 or cooking utensil 12 (FIG. 1). Thus, temperature switch 36 may be configured for detecting the temperature of heating assembly 22 or cooking utensil 12 above electric heating element 21.

Temperature switch 36 may generally be operable to restrict a voltage to first resistive coil 24 and/or second resistive coil 26 above a predetermined temperature. Specifically, temperature switch 36 may actuate from a first, e.g., activated, state (FIG. 4) to a second, e.g., deactivated, state (FIG. 5), based on the detected temperature. For instance, certain embodiments of temperature switch 36 are provided as a magnetic switch. As described in detail below, magnetic temperature switch 36 actuates or adjusts from the first state to the second state when a temperature at electric heating element 21 exceeds a predetermined threshold temperature. The threshold temperature may be any suitable temperature. For example, the threshold temperature may be about three hundred fifty degrees Celsius. As another example, the threshold temperature may be above three hundred sixty degrees Celsius. Optionally, the threshold temperature may be above four hundred degrees Celsius. As yet another example, the threshold temperature may between about ninety degrees Celsius and about four hundred twenty-five degrees Celsius. As used herein, the term "about" corresponds to within twenty-five degrees of a stated temperature when used in the context of temperature.

A first electrical conduit 42 is coupled to first terminal 46 of first resistive coil 24. In some embodiments, first electrical conduit 42 may be further coupled to third terminal 52 of second resistive coil 26, e.g., via a common conductive coupler connecting first terminal 48 and third terminal 52. Optionally, first resistive coil 24 and second resistive coil 26 may be coupled in parallel, as illustrated. First electrical conduit 42 is configured for operating at a first voltage, L1, with respect to ground. Thus, first electrical conduit 42 may be coupled or connected to a first voltage source operating at the first voltage L1 with respect to ground. A pair of second electrical conduits, e.g., a primary second conduit 44A and a matched second conduit 44B, each configured for operating at a second voltage, L2, with respect to ground. As shown, each second electrical conduit 44A, 44B is provided in parallel. Thus, each second electrical conduit 44A, 44B may be coupled or connected to a second voltage source operating at the second voltage L2 with respect to ground. The first and second electrical conduits 42, 44A, 44B may be any suitable electrical conduits, such as wires, cables, etc.

The first voltage L1 and the second voltage L2 have opposite polarities. In addition, a magnitude of the first voltage L1 with respect to ground may be about equal to a magnitude the second voltage L2 with respect to ground. As an example, the magnitude of the first and second voltages L1, L2 may be about one hundred and twenty volts with respect to ground. Thus, e.g., first electrical conduit 42 may be coupled to one phase of a two-hundred and forty volt household electrical supply, and each of second electrical conduits 44A, 44B may be coupled to the second phase of the two-hundred and forty volt household electrical supply.

Temperature switch 36 may be connected to at least one of second conduits 44A, 44B (e.g., primary second conduit 44A) in series between second terminal 48 and second voltage L2. As described above, temperature switch 36 may selectively adjust between a first and second state. Accordingly, temperature switch 36 may selectively couple or connect second terminal 48 to the one of second electrical conduits 44A. As shown, temperature switch 36 is electrically connected in series with first resistive coil 24. By selectively coupling or connecting the second terminal 48 of electric heating element 21 to second electrical conduit 44A, a power output of electric heating element 21 may be regulated with temperature switch 36. Temperature switch 36 may be electrically isolated from second resistive coil 26. For instance, as provided in the exemplary embodiments of FIGS. 4 and 5, temperature switch 36 may be parallel to the second conduit 44B that is connected in series with fourth terminal 54. The second resistive coil 26 may thus operate independent of temperature switch 36.

Figure 6:
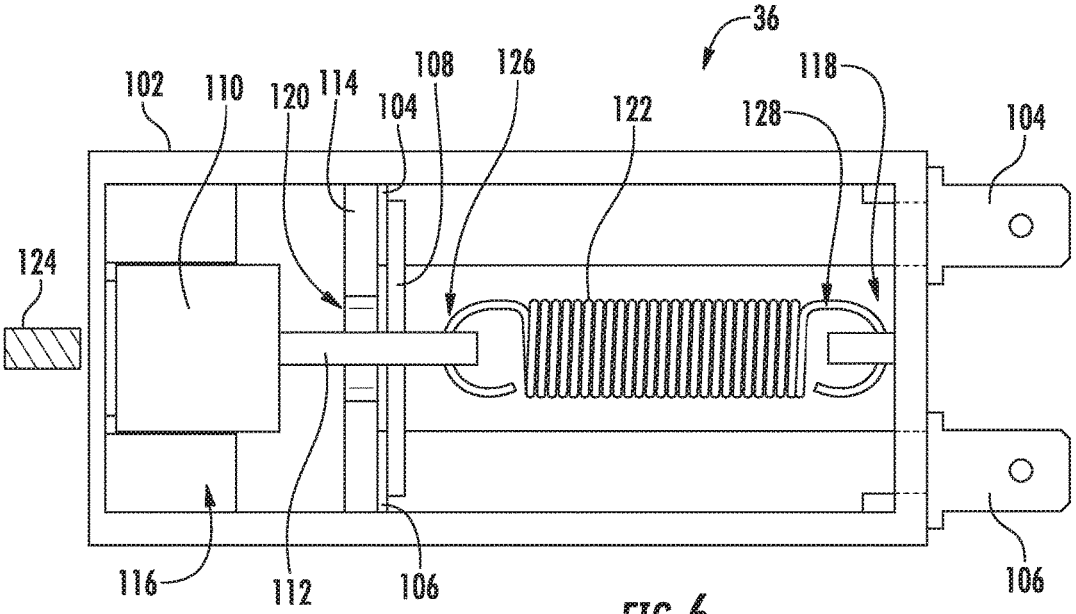
FIG. 6 provides a bottom view of a temperature switch for a cooktop appliance according to an example embodiment of the present disclosure, wherein the temperature switch is provided in an activated state.
Figure 7:
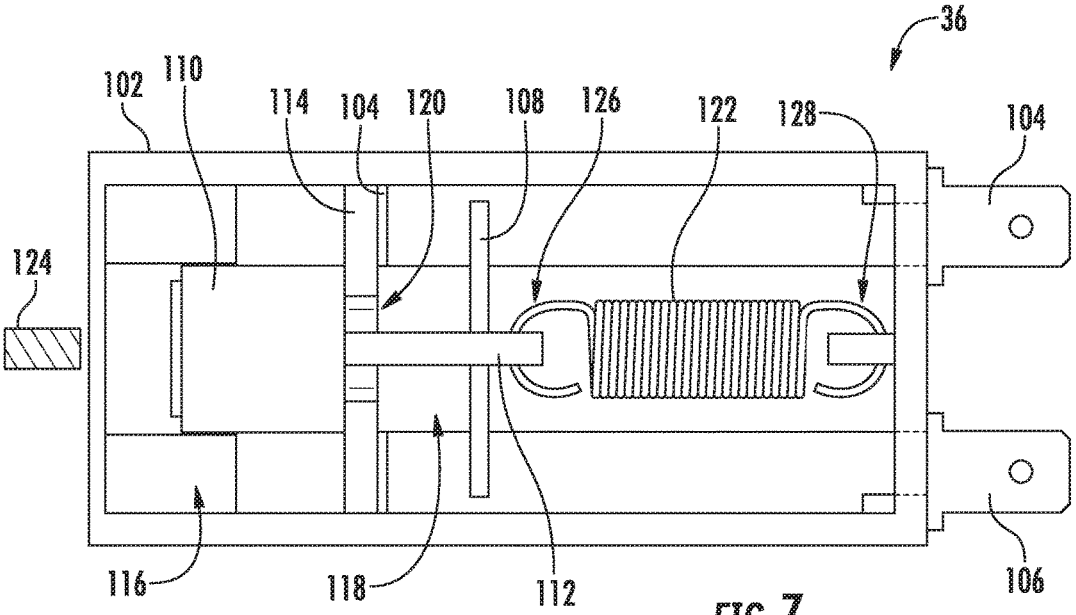
FIG. 7 provides a bottom view of the example temperature switch of FIG. 6, wherein the temperature switch is provided in a deactivated state.

Turning to FIGS. 6 and 7, magnetic temperature switch 36 includes switch body 102 supporting a first prong 104 and a second prong 106. Generally, prongs 104, 106 may be conductive metallic members that can electrically couple magnetic temperature switch 36 to an electrical conduit (e.g., second electrical conduit 44 (FIG. 3)). An articulating connection plate 108 may be positioned between the prongs 104, 106, e.g., in series between first prong 104 and second prong 106. In some embodiments, connection plate 108 articulates within switch body 102. Specifically, connection plate 108 may be attached to a moving magnetic element 110 to move therewith.

In some embodiments, connection plate 108 is fixed to a rigid pin 112 extending from magnetic element 110. As magnetic element 110 moves, so does connection plate 108 and rigid pin 112. Optionally, rigid pin 112 may extend through a separation wall 114 of switch body 102. A first chamber 116 may be defined on one side of separation wall 114, while a second chamber 118 is defined on the opposite side of separation wall 114. For instance, magnetic element 110 may be disposed within first chamber 116, while connection plate 108 is disposed within second chamber 118. Rigid pin 112 may extend into both first chamber 116 and second chamber 118 through a channel 120 defined by separation wall 114.

A mechanical spring 122 may attach to connection plate 108, e.g., via rigid pin 112. Mechanical spring 122 may be configured to bias or motivate connection plate 108 within switch body 102, e.g., away from second chamber 118. In certain embodiments, mechanical spring 122 is a tension spring extending between two opposite ends 126, 128. One end 126 may be fixed to rigid pin 112, while the opposite end 128 is fixed to a segment of switch body 102. It should be noted that although mechanical spring 122 is illustrated as a tension spring, alternative embodiments may be a compression spring, diaphragm spring, cantilever spring, leaf spring, or another suitable embodiment configured to bias connection plate 108 as described.

A ferromagnetic tab 124 may be in selective magnetic engagement with (e.g., magnetically attracted to) magnetic temperature switch 36. Specifically, ferromagnetic tab 124 may be in selective magnetic engagement with magnetic element 110. As shown, ferromagnetic tab 124 may be positioned proximate to magnetic temperature switch 36. When assembled, magnetic element 110 is thus generally biased toward ferromagnetic tab 124. However, once ferromagnetic tab 124 is heated above a Curie temperature thereof (e.g., via heat conducted from heating assembly 22 (FIG. 1)), ferromagnetic tab 124 may lose permanent magnetism. The magnetic engagement between ferromagnetic tab 124 and magnetic element 110 may be broken, and magnetic element 110 may be subsequently motivated away from ferromagnetic tab 124 (e.g., by mechanical spring 122).

Ferromagnetic tab 124 may be formed from one or more suitable ferromagnetic materials. The material of ferromagnetic tab 124 may be determined according to a desired Curie temperature. Thus, the materials of ferromagnetic tab 124 may be selected to such that the Curie temperature of ferromagnetic tab 124 corresponds to or defines the threshold temperature. In some embodiments, the ferromagnetic tab 124 may be formed from nickel or one or more nickel alloys. Advantageously, temperature switch 36 may have a higher predetermined temperature than possible with existing (e.g., bimetal switch) systems.

Figure 8:
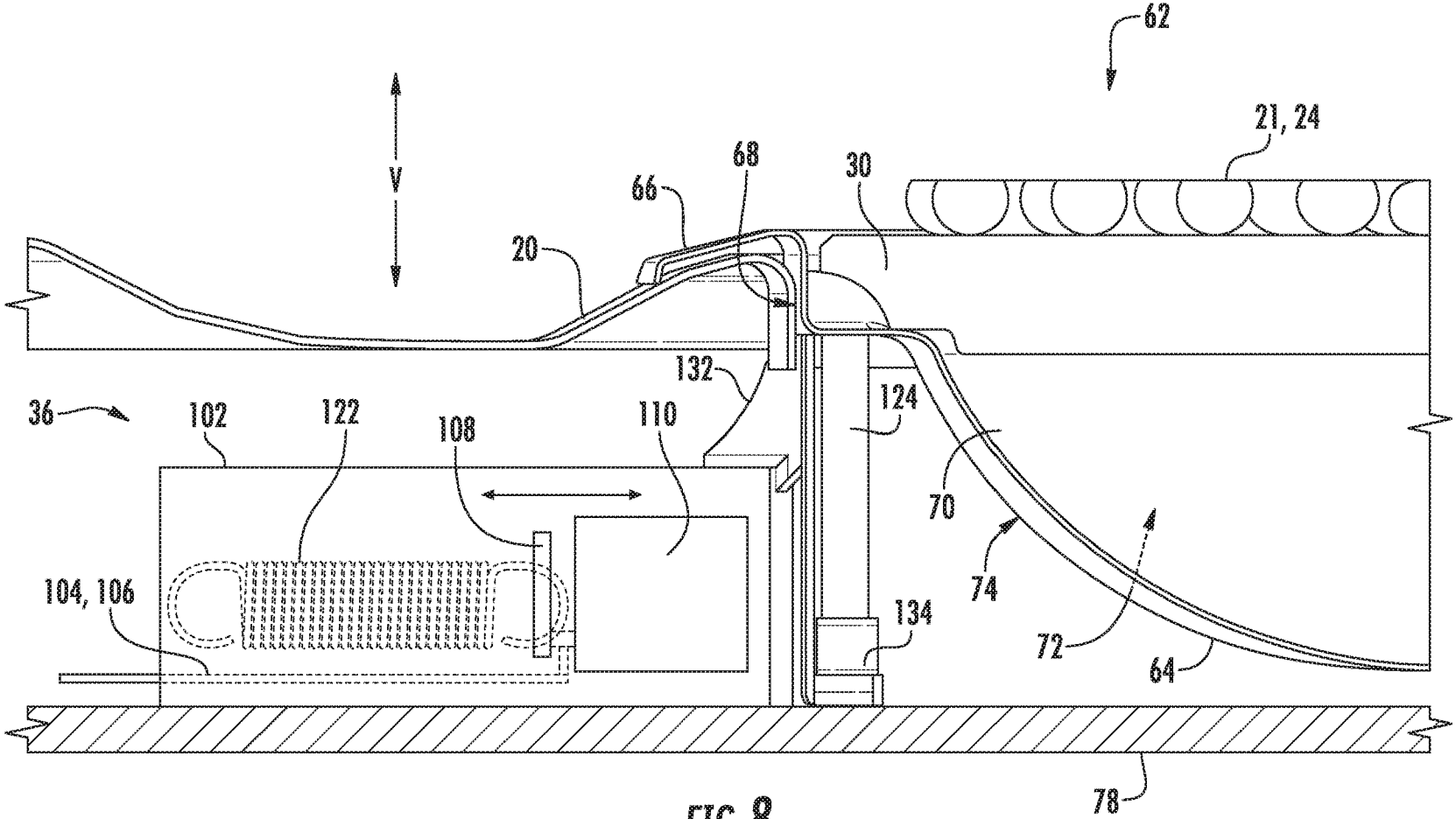
FIG. 8 provides a side perspective view of a heating assembly a cooktop appliance, including a temperature switch, in according to exemplary embodiments of the present disclosure.
Figure 9:
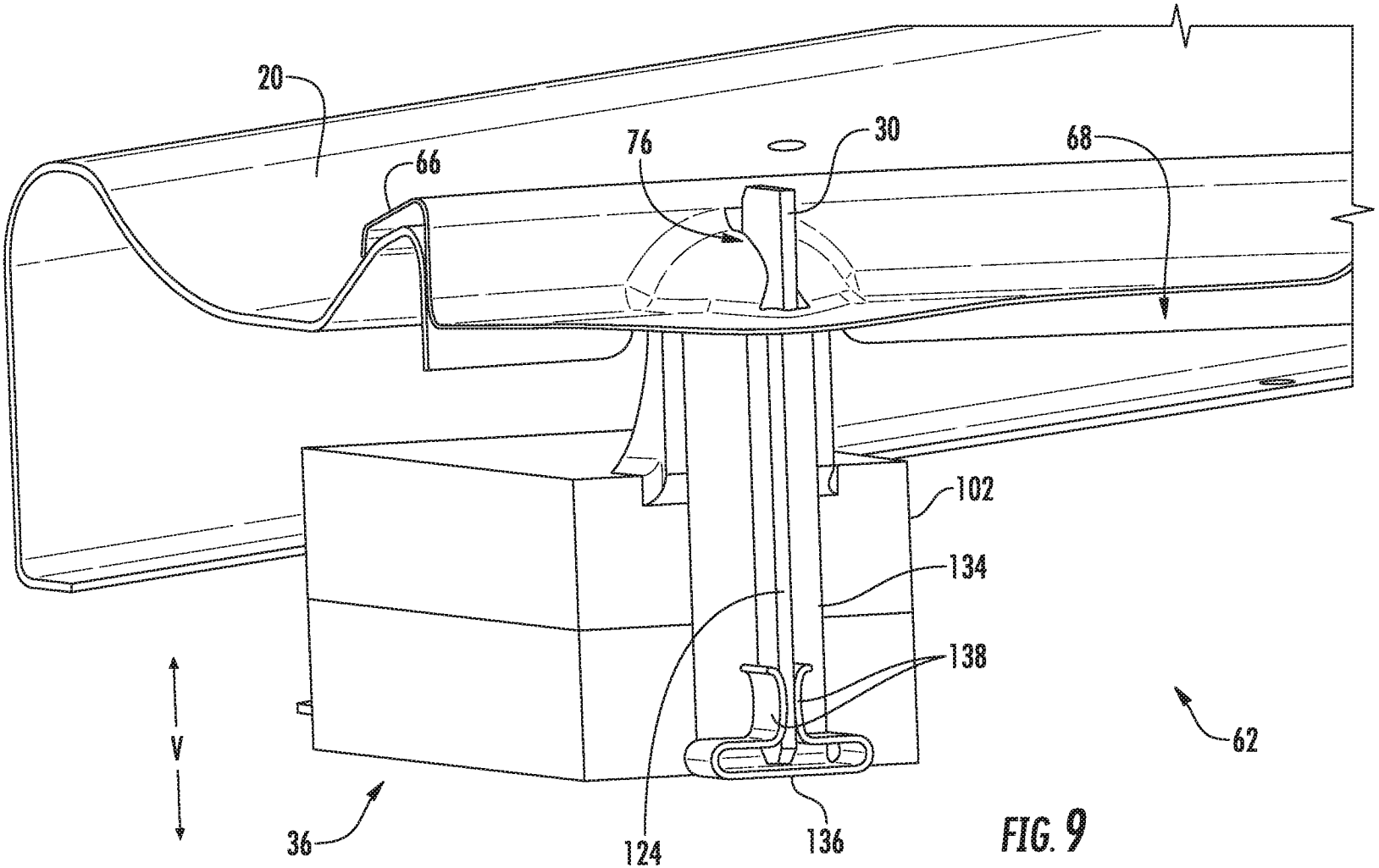
FIG. 9 provides a perspective view of the example temperature switch of FIG. 8.

Turning to FIGS. 8 and 9, an exemplary heating assembly 62 is illustrated. It is understood that heating assembly 62 may generally correspond to the heating assembly 22 of cooktop appliance 10 (FIG. 1). As shown, some embodiments of heating assembly 62 may include an electric heating element 21 positioned at cooktop panel 20. For instance, at least a portion of electric heating element 21 may be positioned above hole 68 defined through panel 20. Heating element 21 may be supported on mounting element 30 positioned therebelow. Mounting element 30 may engage heating element 21 in direct contact. During operation, at least a portion of the heat generated at heating element 21 may be conducted to mounting element 30.

A drip pan 64 may be attached, e.g., removably attached, to panel 20 below electric heating element 21. Mounting element 30 may be positioned between drip pan 64 and heating element 21. In some embodiments, drip pan 64 includes a support lip 66 extending along circumferentially outward to rest on a top surface of panel 20, e.g., about hole 68. When mounted, a concave sidewall 70 may extend below panel 20. For example, a portion of concave sidewall 70 may extend through hole 68 from support lip 66. Concave sidewall 70 may include an inner surface 72 facing the hole 68 and/or electric heating element 21. An outer surface 74 of concave sidewall 70 may be positioned opposite inner surface 72 to face away from hole 68 and/or electric heating element 21.

Some embodiments include temperature switch 36 mounted below cooktop panel 20 along the vertical direction V. Additionally or alternatively, temperature switch 36 is positioned below heating element 21. Advantageously, the temperature switch 36 may be positioned outside of a potential pool zone where water (e.g., spilled over from a utensil positioned on heating element 21) may collect within drip pan 64. One or more mechanical fasteners (not pictured) or adhesives may fix temperature switch 36 to a base wall 78 extending below cooktop panel 20 (e.g., between the cooking cavity and door 14 (FIG. 1) and cooktop panel 20 along the vertical direction V). Additionally or alternatively, mechanical fasteners or adhesives may fix temperature switch 36 to cooktop panel (e.g., at an integral mounting bracket 132 extending from switch body 102) such that temperature switch 36 is positioned below heating element 21.

Temperature switch 36 may include a retainer bracket 134 to receive ferromagnetic tab 124. A support plate 136 of retainer bracket 134 may be positioned below ferromagnetic tab 124, e.g., in support thereof, while resilient fingers 138 extend above support plate 136 on opposite sides of ferromagnetic tab 124. When assembled, resilient fingers 138 may align ferromagnetic tab 124 relative to support plate 136. Optionally, resilient fingers 138 may form a spring clip holding ferromagnetic tab 124 to retainer bracket 134. Retainer bracket 134 may generally hold ferromagnetic tab 124 below heating element 21. In some such embodiments, retainer bracket 134 is positioned radially inward from magnetic element 110.

Ferromagnetic tab 124 is generally provided in thermal engagement with heating element 21. For instance, ferromagnetic tab 124 may contact mounting element 30 to receive heat generated from heating element 21, e.g., such that the temperature at ferromagnetic tab generally reflects the temperature at heating element 21. In some such embodiments, ferromagnetic tab 124 is integral with mounting element 30 as a singular unitary feature. In alternative embodiments, ferromagnetic tab 124 is a discrete separable component in direct contact with mounting element 30. During operations, heat may be conducted to ferromagnetic tab 124 from heating element 21.

In some embodiments, a slot 76 may be defined in drip pan 64 to receive ferromagnetic tab 124. When assembled, ferromagnetic tab 124 may extend from mounting element 30, through slot 76, and to retainer bracket 134 of temperature switch 36.

Returning to FIGS. 6 and 7, a portion of temperature switch 36, including articulating connection plate 108, is generally moveable between a first position (FIG. 6) and a second position (FIG. 7). The first position and second position may generally correspond to the activated and deactivated state, respectively.

As illustrated, in the first position of FIG. 6, articulating connection plate 108 is biased toward ferromagnetic tab 124. The first position may be provided when the temperature is below the predetermined threshold temperature, e.g., when ferromagnetic tab 124 is at a temperature below its Curie temperature. Generally, magnetic engagement between ferromagnetic tab 124 and magnetic element 110 forces or motivates connection plate 108 toward ferromagnetic tab 124, overcoming the opposite force generated by mechanical spring 122. In the first position, magnetic element 110 conductively engages with and electrically couples the prongs 104, 106. Connection plate 108 completes or closes an electrical circuit between the prongs 104, 106 such that they are connected in series. Magnetic temperature switch 36 may thus be in the activated state.

By contrast, in the second position of FIG. 7, articulating connection plate 108 is biased away from the ferromagnetic tab 124. The second position may be provided when the temperature is above the predetermined threshold temperature, e.g., when ferromagnetic tab 124 is at a temperature above its Curie temperature. Generally, the force generated by mechanical spring 122 forces or motivates connection plate 108 away from ferromagnetic tab 124. Reduction in magnetism for ferromagnetic tab 124 may allow the force generated by mechanical spring 122 to reposition connection plate 108 apart from prongs 104, 106. Specifically, connection plate 108 may be spaced away from the first and second prongs 104, 106 to prevent conduction therebetween. The electrical circuit between the prongs 104, 106 will be open such that the prongs 104, 106 are not connected in series. Magnetic temperature switch 36 may thus be in the deactivated state.

As described above, temperature switch 36 may alternate between the first position and the second position according to the magnetism between ferromagnetic tab 124 and magnetic element 110. Temperature switch 36 may rapidly transition from the first position to the second position when the temperature of ferromagnetic tab 124 is raised above the Curie temperature thereof. Moreover, temperature switch 36 may rapidly transition from the second position to the first position when the temperature of ferromagnetic tab 124 is lowered below the Curie temperature. Advantageously, the system temperature switch 36 may rapidly transition from an activated state to a deactivated state (and vice versa) while reducing the potential for nuisance tripping (e.g., in comparison to a bimetal switch system).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance comprising:

a cooktop panel;

an electric heating element positioned at the cooktop panel, the electric heating element including a first terminal and a second terminal;

a ferromagnetic tab in stationary, conductive, thermal engagement with the electric heating element; and a magnetic temperature switch positioned in selective magnetic engagement with the ferromagnetic tab, the magnetic temperature switch being electrically connected in series with the second terminal and operable to restrict a voltage to the electric heating element above a predetermined temperature, wherein the magnetic switch comprises a retainer bracket disposed below the ferromagnetic tab, a switch body mounted to the retainer bracket, a magnetic element housed within the switch body radially outward from the retainer bracket, an articulating connection plate fixed to the magnetic element within the switch body, and a mechanical spring motivating the connection plate and magnetic element radially outward away from the ferromagnetic tab, and wherein the ferromagnetic tab is positioned below the heating element and received within the retainer bracket.

2. The cooktop appliance of claim 1, wherein the electric heating element comprises a first resistive coil, the first resistive coil comprising the first terminal and the second terminal.

3. The cooktop appliance of claim 2, wherein the electric heating element comprises a second resistive coil, the second resistive coil comprising a third terminal and a fourth terminal.

4. The cooktop appliance of claim 3, further comprising:

a first electrical conduit connected in series with the first terminal and the third terminal, a second electrical conduit connected in series with the second terminal and the temperature switch, and a third electrical conduit connected in series with the fourth terminal.

5. The cooktop appliance of claim 1, wherein the predetermined temperature is equal to a Curie temperature of the ferromagnetic tab.

6. The cooktop appliance of claim 5, wherein the Curie temperature of the ferromagnetic tab is above 360° Celsius.

7. The cooktop appliance of claim 6, wherein the magnetic switch includes a first prong and a second prong, and wherein the connection plate is disposed in series between the first prong and the second prong.

8. The cooktop appliance of claim 7, wherein the connection plate is disposed in conductive engagement with the first and second prongs in the first position, and wherein the connection plate is spaced away from the first and second prongs in the second position to prevent conduction therebetween.

9. A cooktop appliance comprising:

a cooktop panel;

an electric heating element positioned at the cooktop panel;

an element frame supporting the electric heating element, the element frame being positioned below the electric heating element;

a ferromagnetic tab extending from the element frame in stationary, conductive, thermal engagement with the electric heating element; and a magnetic temperature switch positioned in selective magnetic engagement with the ferromagnetic tab, the magnetic temperature switch being operable to restrict a voltage to the electric heating element above a predetermined temperature, wherein the magnetic switch comprises a retainer bracket disposed below the ferromagnetic tab, a switch body mounted to the retainer bracket, a magnetic element housed within the switch body radially outward from the retainer bracket, an articulating connection plate fixed to the magnetic element within the switch body, and a mechanical spring motivating the connection plate and magnetic element radially outward away from the ferromagnetic tab, and wherein the ferromagnetic tab is positioned below the heating element and received within the retainer bracket.

10. The cooktop appliance of claim 9, wherein the electric heating element comprises a first resistive coil.

11. The cooktop appliance of claim 10, wherein the temperature switch is electrically connected in series with the first resistive coil.

12. The cooktop appliance of claim 10, wherein the electric heating element further comprises a second resistive coil.

13. The cooktop appliance of claim 12, wherein the temperature switch is electrically connected in series with the first resistive coil and electrically isolated from the second resistive coil.

14. The cooktop appliance of claim 9, wherein the predetermined temperature is equal to a Curie temperature of the ferromagnetic tab.

15. The cooktop appliance of claim 14, wherein the Curie temperature of the ferromagnetic tab is above 360° Celsius.

16. The cooktop appliance of claim 9, wherein the magnetic switch includes a first prong and a second prong, and wherein the connection plate is disposed in series between the first prong and the second prong.

17. The cooktop appliance of claim 16, wherein the connection plate is disposed in conductive engagement with the first and second prongs in the first position, and wherein the connection plate is spaced away from the first and second prongs in the second position to prevent conduction therebetween.

* * * * *